US006729104B2

(12) United States Patent
Marshall

(10) Patent No.: US 6,729,104 B2
(45) Date of Patent: May 4, 2004

(54) PNEUMATIC CRIMPING AND CAPPING HANDHELD TOOL

(76) Inventor: Kenneth Edward Marshall, Pinfold House, Almond Close, Barby, Nr Rugby, Warwickshire (GB), CV23 8TL ( * ) Notice: Subject to any disclaimer, the term of this patent is extended or adjusted under 35 U.S.C. 154(b) by 0 days.

(21) Appl. No.: 10/203,795

(22) PCT Filed: Feb. 9, 2001

(86) PCT No.: PCT/GB01/00503

§ 371 (c)(1),
(2), (4) Date: Aug. 14, 2002

(87) PCT Pub. No.: WO01/58800

PCT Pub. Date: Aug. 16, 2001

(65) Prior Publication Data

US 2003/0051890 A1 Mar. 20, 2003

(30) Foreign Application Priority Data

Feb. 14, 2000 (GB) ..... 0003121

(51) Int. Cl.[7] ..... B65B 7/28

(52) U.S. Cl. ..... 53/331; 53/348; 53/354; 53/353; 81/3.2; 72/453.01; 72/453.02

(58) Field of Search ..... 53/331, 348, 350, 53/354, 351, 353; 81/3.2; 72/402, 453.01, 453.02, 453.04, 453.15, 453.16, 452.3, 452.4

(56) References Cited

U.S. PATENT DOCUMENTS 2,146,347 A * 2/1939 Pityo ..... 53/478
2,579,775 A * 12/1951 Allen et al. ..... 53/350
2,839,883 A * 6/1958 Roberts et al. ..... 53/348
3,037,407 A 6/1962 Maclaren
3,216,289 A 11/1965 Lyman
3,689,951 A * 9/1972 Van Hecke et al. ..... 470/46
3,747,441 A 7/1973 Amtsberg et al.
4,226,110 A * 10/1980 Suganuma ..... 72/416
4,292,833 A * 10/1981 Lapp ..... 72/416
6,076,330 A * 6/2000 Thomas et al. ..... 53/75
6,196,045 B1 * 3/2001 Thomas et al. ..... 72/454
6,446,482 B1 * 9/2002 Heskey et al. ..... 72/453.16
6,477,919 B1 * 11/2002 Thomas et al. ..... 81/3.2

FOREIGN PATENT DOCUMENTS

GB 1197223 7/1970
GB 2 213 137 A 8/1989

OTHER PUBLICATIONS 2 pages from Applicant's web site, www.crimpers–and–decappers.com.

* cited by examiner

*Primary Examiner*—Rinaldi I. Rada
*Assistant Examiner*—Gloria R Weeks
(74) *Attorney, Agent, or Firm*—Young & Thompson

(57) ABSTRACT

A hand-held, power-operated or power-assisted, crimping/er or decapping/er tool (60), for container closures, such as vial caps (C), has a hollow handle (50), housing a (pneumatic) piston-in-cylinder actuator (12, 13), with an external trigger (18) operating an internal control valve (16), to control connection of an external pressure supply, through an internal distribution block (11), and displacement of an actuator output rod (15), coupled, through a pivoted bell crank lever (10), to a demountable crimping/er or decapping/er (27).

7 Claims, 4 Drawing Sheets

PNEUMATIC CRIMPING AND CAPPING HANDHELD TOOL

BACKGROUND OF INVENTION

1. Field of Invention

The present invention relates to a so-called 'crimping/er' and 'decapping/er' tool—particularly, but not exclusively, for container closures, such as used for sample vials, atomisers, infusion bottles and the like.

The closure is typically a circular cap, with a depending annular peripheral skirt, which forms a (mechanically secure) circumferential edge joint or seal with a (upstanding) neck of a container access opening.

Terminology

Crimping

The term 'crimping' is used herein to embrace the (re-) shaping of a deformable (wall) element, say of thin sheet material—by locally applied force—such as to bring the element profile into (close) conformity with a (rigid) contact surface.

In this way, intimate—indeed sealing—joint engagement can be achieved.

Moreover, a continuous peripheral edge seal can be effected around the circumferential rim of an access opening or mouth—vis to a container—in a singe (re-) shaping action.

Decapping

Similarly, the term 'decapping' is used for the 'reverse' process—that is (re-) shaping, or deformation, for closure cap removal from a container access opening.

Cap removal typically involves depressing a mid-portion over a container access opening about the gripped rim, to break or separate a peripheral edge seal.

In practice, it is convenient for the same operating tool—with an appropriate (demountable) working (ie workpiece contact) head—to be used selectively for either crimping or de-capping.

2. Prior Art

Crimpers and decappers, of various (jaw) sizes or capacities, for such purposes are known.

Typically a 'plier' type tool configuration, is adopted, of two pivotally interconnected operating handles.

One handle commonly carries, or is associated with, a crimping/er or decapping/er unit, and the other an actuator therefor.

Hitherto known crimpers and decappers suffer from various operational disadvantages—one being that they can soon tire the user, in repetitive operation.

This reflects adverse tool ergonomics, such as excessive weight or bulk, inappropriate leverage—ie mechanical advantage, required manual force and attendant handle travel—and geometry—ie path of hand movement.

SUMMARY OF INVENTION

The Applicant has devised a stand-mounted crimper-decapper press tool—the subject of GB 2,213,137—featuring an adjustable work unit cradle, using a long operating arm to afford significant mechanical advantage, and so alleviate operator fatigue.

The Applicant has also since devised a light-weight, (die cast metal body) ergonomic hand-held, plier type crimper-decapper, for low intensity use.

A hand tool allows mobility and thus flexibility of operation.

In certain repetitive and/or high capacity applications—such as previously associated with a stand-mounted tool—there is a requirement for a more powerful and heavy-duty hand tool.

Statement of Invention

According to one aspect of the invention, a hand held, power-operated or power-assisted, crimper and/or decapper tool, comprises

- a hollow handle body, housing a fluid powered actuator;
- a fluid control valve, for controlling fluid pressure supply to the actuator;
- and an operating trigger for the control valve;
- a transverse head portion, with a demountable connection, for an output unit, and housing a drive transfer coupling, for operative driving connection between the actuator and a mounted output unit, characterized by a pivoted bell crank, with angularly offset, differential length, lever arms, configured to impart angular displacement, and mechanical advantage, through one crank arm engaging an actuator output rod and the other engaging a drive plunger, of a (demountable) crimping/er and decapping/er unit.

Conveniently, the fluid actuator comprises a piston-in-cylinder device, with a piston coupled to an output drive rod.

In a particular construction, the handle body comprises an elongate hollow tubular body, with an angled head portion at one end and an external operating trigger.

A remote internal drive coupling, such as a push rod, between trigger and control valve, allows their location at opposite ends of the body.

Thus the trigger is conveniently 'forward' at the head and the control valve 'rearward'.

Desirably, the handle body also accommodates a fluid distribution block, alongside the control valve, together configured to control the supply of fluid pressure, to an actuator drive chamber.

The handle body may also incorporate detachable (hose) connection ports for an external fluid pressure supply.

In a particular overall arrangement, internal fluid pressure within a piston-in-cylinder (drive) chamber, displaces a piston, with a linearly slidable (drive) rod, contacting one arm of a pivoted bell crank lever, to impart angular displacement, with mechanical advantage, in turn applied to a drive plunger of a crimping/er and decapping/er unit.

The piston is desirably biassed towards a distribution block at the opposite end of the handle body from the head.

The head may comprise a hollow body housing a bell crank lever, pivotally mounted to the housing wall—for example adjacent a mounting aperture for an output head assembly, such as a crimper or decapper unit or module.

In a particular construction, a relatively short lever arm of the bell crank is disposed alongside the pivot and juxtaposed with a drive plunger of a crimper or decapper unit when installed.

This leaves a relatively longer lever arm of the bell crank spanning between crank pivot and the end of the piston drive rod.

In this way, linear translational movement of the piston and entrained drive rod is transferred, through angular throw of the bell crank, to linear translational movement of an (installed) crimper/decapper drive plunger—but through an angular offset, eg of some ninety degrees.

This angular offset allows a comfortable, ergonomic hand and wrist holding position for the tool, in relation to a container with a closure to be fitted or removed, and held in the other hand.

Conveniently, the body supports a (finger-operated) squeeze or pull-action trigger, for actuating the fluid control valve.

The trigger is desirably accommodated within a guard spanning a corner quadrant between the handle body and head, with a remote trigger movement transfer rod alongside the drive chamber and between trigger at one end and control valve at the other end.

The control valve is conveniently located alongside a distribution block, itself incorporating connector fittings for fluid pressure supply.

In practice fluid drive pressure may be derived from pneumatic and/or hydraulic remote source—such as a pump, or reservoir.

The crimping and decapping unit may embody a collet-chuck, for demountable fitting of different sized crimper or decapper units.

A collet-chuck has a plurality of radially displaceable jaws and an (intervening) axially-displaceable punch, for initiating (relative) jaw movement.

Overall, such a hand-held tool can be configured as light, ergonomic and power-assisted, or power-driven—such as by pneumatic or hydraulic pressure—thereby reducing the physical effort required to carry out a crimping or decapping operation.

BRIEF DESCRIPTION OF DRAWINGS

There now follows a description of some particular embodiments of the invention, by way of example only, with reference to the accompanying diagrammatic and schematic drawings, in which:

FIG. 6A shows a preliminary stage of juxtaposition of tool head, with installed crimper unit, featuring an open collet chuck—over a vial container, with a loosely fitted closure cap;

FIG. 6B shows initiation of tool operation, by squeezing the trigger to enable the drive piston and rod and actuate the crimper drive plunger and close the crimper collet chuck around the circumference of the closure, to press the same into intimate contact with the vial neck rim, the chuck jaw profile featuring an under slung lip to turn the closure cap under the neck rim; and FIG. 6C shows release and separation of the tool and vial, leaving a sealed closure cap.

DETAILED DESCRIPTION OF INVENTION

Figure 1:
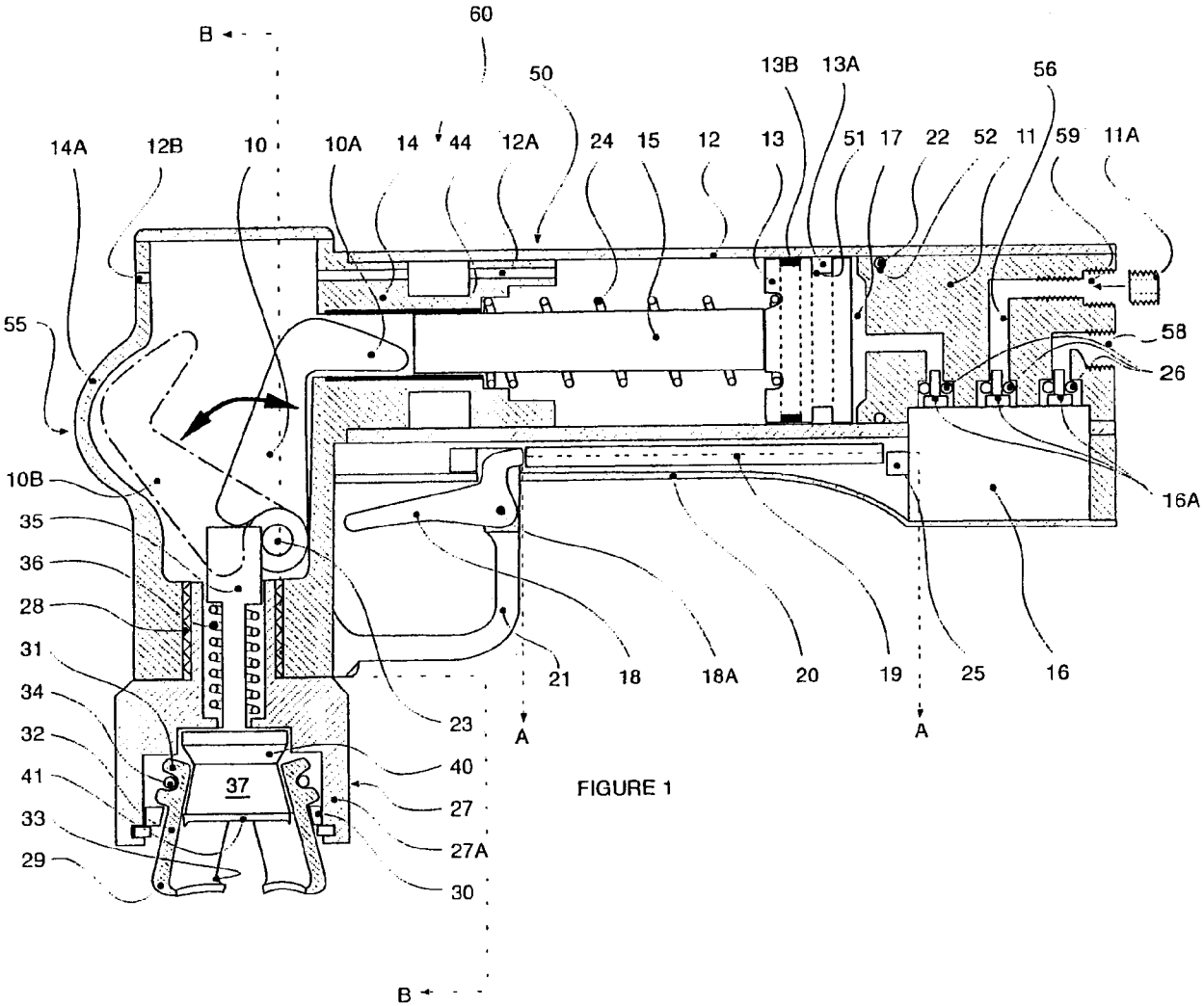
FIG. 1 shows a sectional side elevational view of a hand-held, power-assisted, crimper and decapper tool according to the invention.

Referring to FIG. 1, a hand-held, power-operated (or power-assisted) crimper and de-capper tool 60 is of overall 'L'-shaped configuration, with an elongate handle body 50 and angularly offset tool head 55, for a demountable crimper or decapper tool unit 27.

The tool 60 incorporates an internal fluid actuator, in this case pneumatic—for compatibility with compressed air supplies commonly available in light industrial and laboratory environments.

The handle body 50 comprises an elongate hollow tubular sleeve or barrel housing 12, upon one (forward) end of which is mounted the tool head 55.

An external operating trigger 18 is disposed in the quadrant between the handle body 50 and head 55.

The housing 12 is preferably of a lightweight material, such as aluminium tubing—of a diameter such that a small adult hand can wrap (comfortably) around it.

The housing 12 forms a containment cylinder for a piston-in-cylinder fluid actuator, with a linearly slidable (reciprocating) piston 13 located coaxially within.

The piston 13 is secured to a drive transfer rod 15 and carries a resilient annual peripheral seal ring 13A, located (captive) within a circumferential groove 51.

A slide ring guide 13B serves to locate the piston centrally within the housing 12, ensuring seal ring 13A is subjected to even pressure.

The seal ring 13A, slide ring guide 13B, piston 13 and drive transfer rod 15 are slidable inside the housing 12, as a unitary piston assembly, biassed by a resilient spring 24.

Figure 6A:
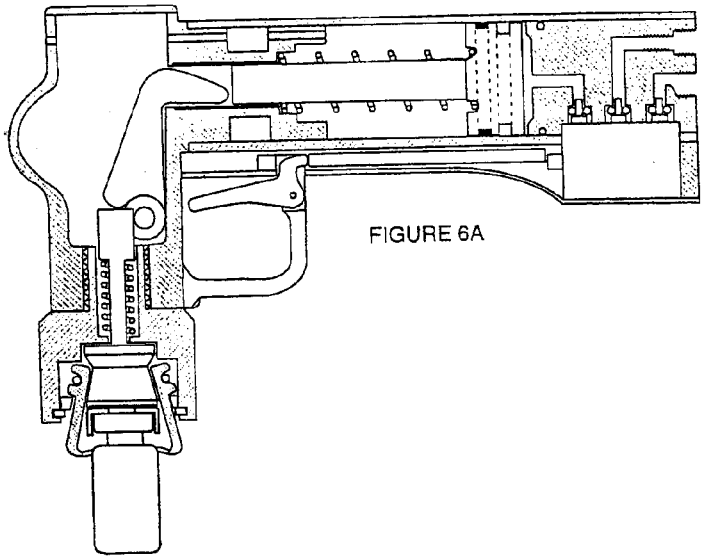
FIGS. 6A, 6B and 6C show successive stages in tool operation; more specifically.
Figure 6B:
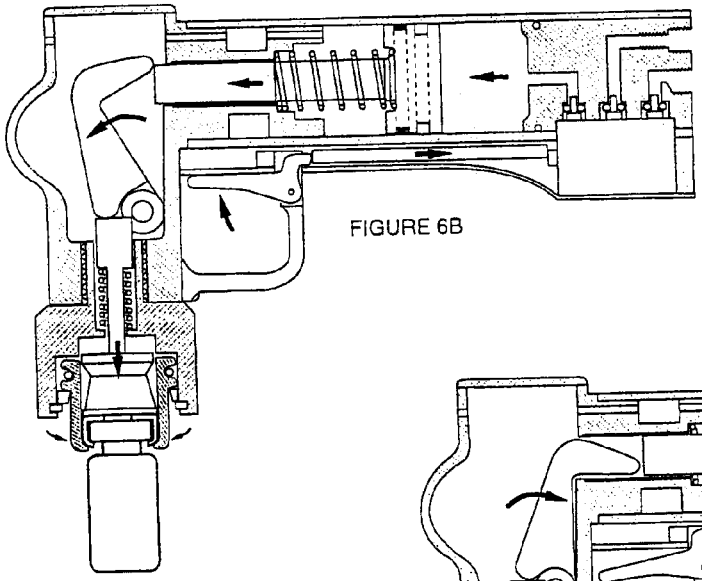
Figure 6C:
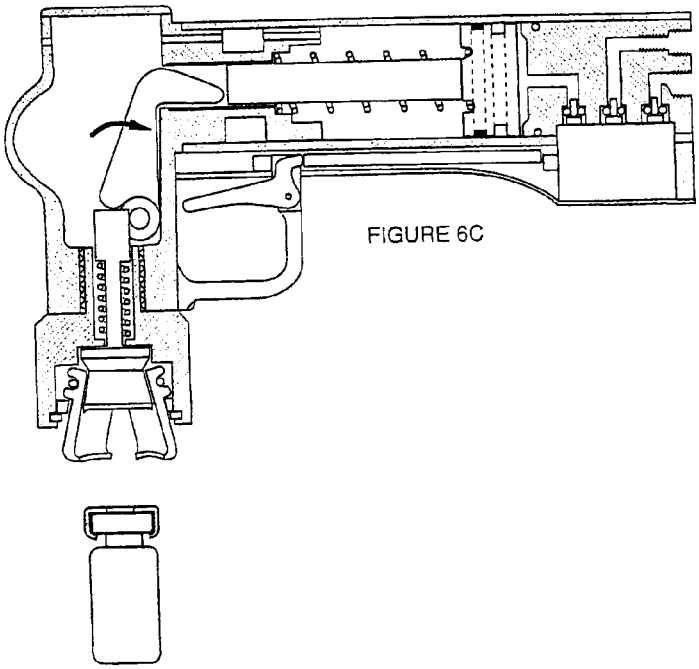

This piston assembly is configured to return the assembly to it's 'normal' retracted, or rearward position (as depicted in FIGS. 1, 6A and 6C), absent sufficient (drive) pressure within a pressurisable drive chamber 17.

An ambient air vent hole 12A facilitates escape and ingress of fluid (air) to the rear (low pressure side) of the piston 13, into a head space within the transition housing 14A of the tool head 55, from which it can escape through a side wall vent 12B.

The drive chamber 17 is disposed between a head of the piston 13 and a fluid distribution block 11 at the rearward end of the housing 12, opposite the tool head 55.

The distribution block 11 is sealed to the inside of the housing 12 by a resilient seal ring 22, located in a circumferential groove 52.

Figure 2:
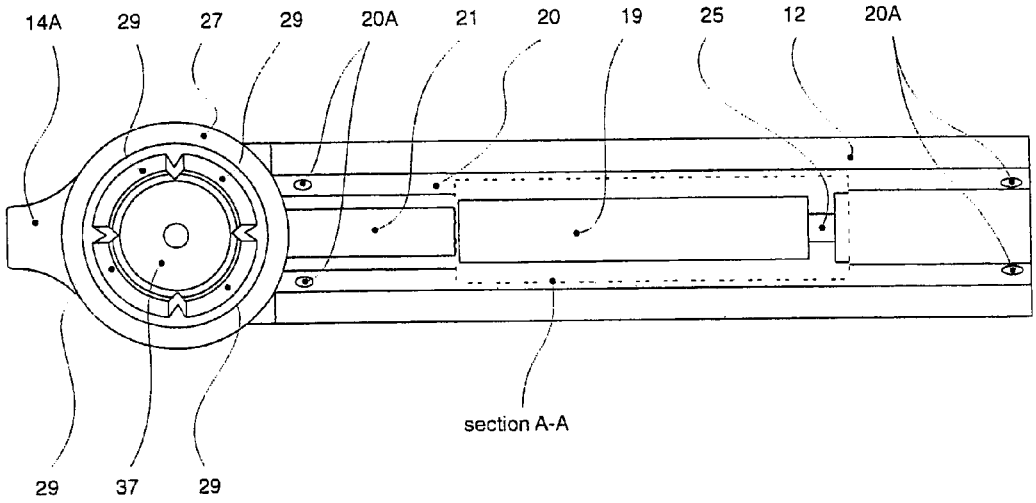
FIG. 2 shows a part cut-away underside plan view of the tool.

The distribution block is held in place by screws 20A, as shown in FIG. 2.

The distribution block 11 incorporates (drilled) fluid (in this example pneumatic) flow passages 56.

These flow passages 56 are configured for selective (inter)connection, through end ports 58, 59 (and appropriate umbilical feed tube or pipes not shown) to any or all of:

a (pneumatic) fluid pressure supply (not shown);

a remote (on board trigger bypass) control valve (not shown); and a remote 'closed' exhaust routing (not shown), to recover (pneumatic) fluid) upon the return stroke of the actuator piston 13, and thereby avoid 'contamination' of a controlled (say laboratory) environment in which the tool is being used.

Transfer of air (or other operating fluid) to and from the pressure chamber 17, is controlled by a mechanically (trigger) operated spool (control) valve 16.

An (outward) operating stroke of the actuator piston 13, and entrained drive rod 15 is achieved by pressurising the chamber 17 with fluid (air).

A chosen inlet 58, 59 to the distribution block 11 is fitted with a restrictor jet 11A, of a size that will give a controlled and steady operation of the crimping/er unit 27.

Tubular shouldered connectors 16A are fitted to the ports of the valve 16.

Opposing shoulders are drilled into the distribution block 11, to accept the tubular shouldered connectors 16A.

A resilient seal ring 26 is positioned over each of the tubular shouldered connectors 16A and against their shoulders and the spool valve 16 is plugged in.

The resilient seal rings 26 are then compressed, between the opposing shoulders, with screws 20A—fitted through a cowl 20.

The cowl 20 locates and maintains the mechanical spool valve 16 in situ.

Proprietary, mechanical spool valves are commercially available in many sizes and configurations.

A suitable valve would be what is known as a '3/2'—and would be as small as possible, preferably with at least three ports on one side.

The tool head 55, at a forward end of the tool 60, comprises a hollow 'transition' (end) housing 14A, with a right-angled locating and mounting spigot 14, protruding from the top at one side.

The spigot 14 is machined to fit inside the tubular handle structure 12 and has a hole located coaxially—and through which the slidable piston rod 15 is displaceable.

Figure 3:
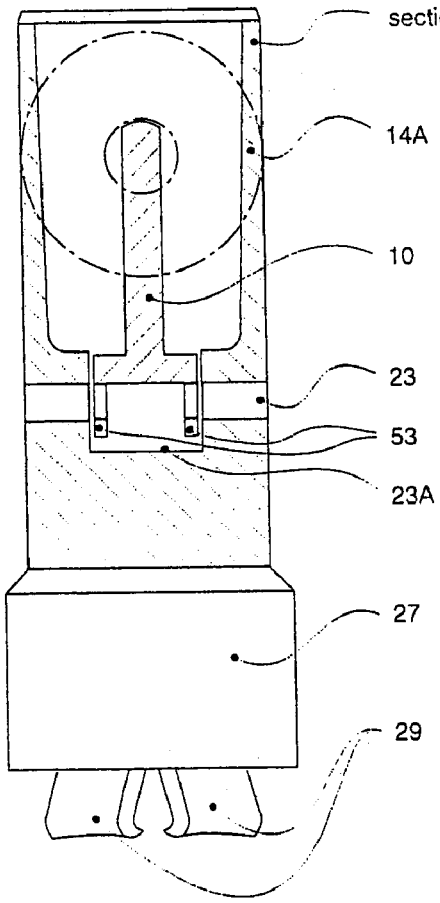
FIG. 3 shows a front view of the tool, with part-section of the bell crank lever.
Figure 4:
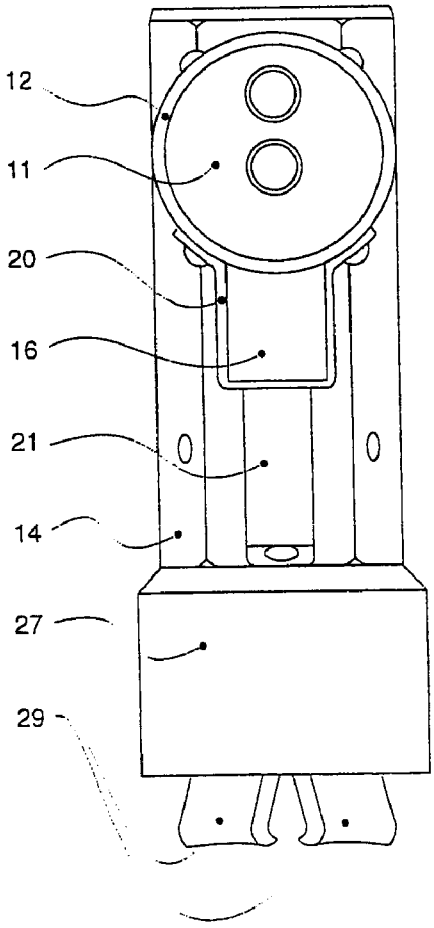
FIG. 4 shows a rear elevational view of the tool.

FIG. 3 shows a slot 23A in the transition housing 14A, designed to accept a bell crank lever 10.

The slot 23A is positioned to the same side as the spigot 14, with the side walls parallel to the tubular body 12.

Located in the slot 23A, and orientated orthogonally to its parallel walls, is a pin 23

The slot 23A accepts the bell crank lever 10, which pivots upon pin 23.

The ends of the bell crank lever arms 10A and 10B are free to slide over the surfaces they are in contact with.

This provides a freer action, preserving input piston rod and output driver plunger relative (orthogonal) geometry of respective translational movement, without captive pivot connections.

The bell crank lever 10 is positioned in the transition housing 14A, so that:

the (sliding) contact point of its longer arm 10A swings equidistance, about the vertical centre line, to pin 23; and the short arm 10B swings equidistance, about the horizontal centre line, to pin 23.

This is to mitigate variation in force applied to an installed crimping/er or decapping/er unit.

Thus, a crimping/er head requires maximum force at the end of the travel, whilst a decapping/er head requires maximum force near the beginning of its travel.

Bell crank lever 10 is configured to impart mechanical advantage over the crimping/er and decapping/er units.

As shown in the sectional view of FIG. 3, the bell crank lever 10 is narrow at the top, to fit into a spigot 14, and forked at the bottom with two parallel arms 53.

These arms 53 'straddle' a drive plunger 35 and allow pin 23 to sit next to it, as shown in FIG. 1.

The long arm 10A of the bell crank lever 10 contacts the piston rod 15, and its short arm 10B depresses the drive plunger 35 of the crimping and decapping unit.

To accommodate travel of the bell crank long arm 10A, the transition housing 14A is enlarged, (specifically flared) locally, opposite the long arm 10A.

This minimises the overall transition housing 14A size and weight.

Similarly, towards weight reduction, the tool housing and component parts feature selective relief of material.

For interchangeability of crimping/er or decapping/er units, a screw thread 28 is formed in the transition housing 14A, directly below the short bell crank lever arm 10B.

Between the housing 12 and cover 20 of the body 50 is disposed a remote operating linkage or coupling between the trigger 18 and the actuator control valve 16.

When (finger squeeze) pressure is applied, the trigger 18 pivots as a cranked lever, about a pin 18A and, by angular displacement, moves a drive transfer rod 19.

The trigger 18 is shrouded by a trigger guard 21, itself retained by the cowl 20—over a protruding shoulder at the trigger end, and by a screw at the other end.

When the trigger 18 is actuated—by applied finger (squeeze) pressure—the drive transfer or coupling rod 19 depresses a valve plunger 25 of the control valve 16.

The control valve 16 in turn routes the pneumatic supply pressure, through the distribution block 11, to pressurise ('charge') the drive chamber 17.

The drive force upon the piston 13 from drive chamber pressurisation overcomes the resistance of the resilient bias return spring 24.

The piston 13 is displaced forward or outward, that is away from the distribution block 11, and the entrained piston rod 15 moves through the spigot 14.

The piston rod 15 impinges upon the long bell crank arm 10A and, by angular displacement about pivot 23, drive force is applied, through the short arm 10B, to the crimping/er and decapping/er unit.

The piston rod 15 is supported by a guide sleeve 44, to preserve linear translational support throughout its range of movement, with minimal sliding resistance.

In practice, the sleeve can comprise a coiled strip of initially flat resilient strip material, wound into a 'closed' cylinder, with overlapped ends—ie leaving no exposed jointing or abutting edge slit.

Alternatively, the guide sleeve 44 may be configured as a rolled cylinder and butt jointed glacier bush.

Considering Tool Operation in More Detail

Crimping

FIG. 1 shows an internal thread 28 which accepts a discrete crimping unit 27 of the collet chuck type, which screws in or out, for replacement with other sizes.

The crimping unit 27 comprises a hollow cylindrical body 27A, with the upper part having a complementary male thread, to that of the transition housing thread 28; the lower part being hollow, to accept the collet assembly.

The jaw assembly comprises four corresponding collets 29, arranged uniformly about the axis of the crimping head 27.

The collets 29 are effectively twin-arm levers, with a fulcrum of a peripheral ring 30, retained in the body 27A by an internal circlip.

Each of the twin-armed levers has an inner arm 31 and an outer arm 32, the outer arm protruding from the crimping unit 27 and provided at its free end with an inwardly-radiused, 'forming' projection.

The inner arms 31 are biased by a resilient ring 34, eg. a coiled spring ring, radially towards the axis of the unit 27, so that the forming projections 33 are normally in an open position, in which they are radially spaced apart sufficiently to enable insertion of a cap to be crimped.

This is the 'relaxed' or open crimper condition depicted in FIGS. 1, 6A and 6C.

The crimping/er unit 27 also carries a drive plunger 35, situated axially of the crimper body 27A and axially displaceable between:

a 'normal' raised position, to which it is biased by a spring 36; and a depressed position, to which it may be transferred by the short bell crank lever arm 10B.

The body 27A carries a profiled punch head 37, which is attached to the plunger 35.

The punch head 37 has an upper/inward a frusto-conical portion 40 and a lower/outward pressure face 41, in the form of an inverted dish, corresponding to the size and shape of the upper part of a closure cap to be crimped.

When the plunger 35 is depressed by the bell crank lever short arm 10B, it overcomes the forces exerted by the resilient ring 34 and the spring 36—whereupon its frusto-conical portion 40 moves between the inner arms 31 and displaces them radially outwardly.

The outer arms 32—and their 'forming' projections 33—are thereby displaced, radially inwardly, to a closed position—in which their inward radiused surfaces converge towards the axis of the unit 27.

With a crimping/er unit installed, a tool according to the invention may be used for crimping various closures for diverse containers.

Crimping Operation

Crimping operation will be described, for simplicity, in connection with a vial of the type used for auto-samplers.

Figure 5:
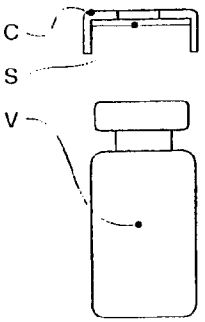
FIG. 5 shows a vial, a cap and a seal.

FIG. 5 shows one such vial V, having on top a neck ending in a collar, which should be closed by a circular seal S and a cap C with a hole in the middle.

In the drawing the thickness of the cap is exaggerated, for clarity of illustration.

In order to seal the vial V, the seal S and cap C are positioned on the collar of the vial, and the assembly is inserted between the forming projections 33, when they are in the open position—as shown in FIG. 6A.

The size of the cap C must correspond to the size of the pressure face 41.

Then the outer arms 32, with their forming projections 33, are closed, upon 'charging' the compression chamber 17, by depressing the trigger 18.

The cap, seal and the collar of the vial are thereby enclosed within the space defined between the outer arms 32, between the forming projections 33, and the pressure face 41.

At this stage, the outer arms 32 are fully closed, but the cap has not yet been crimped.

As the operation continues, the plunger 35 is moved further towards the cap C, whereby the pressure face 41 starts exerting pressure on the cap.

This cap pressure in turn forces the lower end of its' skirt to follow the inward radiused surfaces of the forming projections 33 below the collar, and towards the neck of the vial. This is shown in FIG. 6B.

In this way the cap is crimped and the vial is sealed.

Subsequent tool release and tool separation from the sealed vial, ready for another crimping installation, is shown in FIG. 6C.

It will be appreciated that sealing must take into consideration the actual thickness of the collar, the thickness of the seal S and the thickness of the material of the cap C.

Due to the force generated by pneumatic or hydraulic means, the supply pressure is regulated, to produce a seal.

A careful balance must be struck between applied forces, force travel and fragility of the cap and vial.

By crimping in this way, variation in seal thickness, or collar height, are accommodated—by plunger 35 travel and excess pressure face 41 capacity.

Thus, each vial cap and seal assembly are crimped with equal applied force.

Decapping

A decapping/er head is similar to a crimping head—except that the outer arms of the collet elements have a barb like shoulder, instead of a radiused 'forming' projection, and the punch is smaller at its pressure face.

While the barb like shoulder holds the sides of the cap, the pressure face pushes through—so deforming the cap and ejecting the vial from the cap.

The workpiece contact parts of crimper or decapper are desirably of hardened for wear resistance and plated for corrosion resistance.

Advantages of a crimping/er and decapping/er tool according to the invention include:

modest size of the handle incorporating the tubular compression chamber and piston;

use and positioning of the bell crank drive transfer lever, to minimise the size of the transition housing or operating head and to generate the force of a much larger actuator drive piston pressure area, position of the trigger and actuator control (spool) valve coupling; and option to bypass mechanical spool valve trigger; in favour of remote fluid actuation.

Remote operation of the control valve 16 is achieved by changing the fluid supply tube to an alternative port in the distribution block 11, to couple a remote (say, foot-operated) valve.

In principle, either pneumatic or hydraulic drive pressure could be used, although pneumatic is preferred in practice, as compressed air is more commonly available.

In either case, grouping supply, remote control and exhaust isolation port connection together at one (rear) end of the tool is a compact and advantageous distribution block arrangement—given a compatible control valve mounting in juxtaposition with the block.

To this end, dual tubing may be used.

Provision is desirably made—say through a pressure regulator and gauge (not shown) for adjusting the (pneumatic) fluid pressure supply, to suit different closures and containers.

The tool effectively 'recognises' the applied closure seal pressure and so overcomes dimensional tolerance variations of containers, such as glass vials.

This in turn helps eliminate faulty closure seals.

Thus, once the operating pressure is set, container closures—whether for vials or bottles—can be uniformly and consistently crimped.

As a safety feature, the trigger guard prevents accidental tool operation.

Consistent with light weight a minimal (internal) machining, (die)cast aluminium or alloy may be used for the transition housing Although the tool has been described in relation to closure crimping and decapping, the broad principles—and attendant operational advantages, specifically of ergonomic ease, speed, versatility, flexibility, consistency and safety of use, are applicable to other roles.

Thus tool variants may be used where, say, some clutch or chuck (grip-release) operating action is involved, whether directly upon a workpiece, or as indirect control action for a secondary workpiece interaction device.

Such control action may be instigated by a piston drive rod, a bell crank lever, or an output drive plunger borne upon by a lever arm.

Other, non-fluid, power sources, such as electrical or electromagnetic actuators may be substituted or combined, such as in electro-pneumatic or electro-hydraulic drives.

Component List

10 bell crank lever
10A lever end
10B lever end
11 fluid distribution block
11A restrictor jet
12 elongate tubular sleeve
12A air vent
12B air vent
13 piston
13A seal ring

13B slide ring guide
14 mounting spigot
14A transition housing
15 drive transfer rod
16 valve
16A connectors
17 drive chamber
18 trigger
18A pin
19 drive transfer rod
20 cowl
20A screw
21 trigger guard
22 seal ring
23 pin
23A slot
24 spring
25 valve plunger
26 seal ring
27 demountable crimper or decapper tool unit
27A cylindrical body
28 screw thread
29 collet
30 peripheral ring
31 inner arm
32 outer arm
33 projection
34 resilient ring
35 drive plunger
36 spring
37 punch head
40 upper portion
41 pressure face
44 guide sleeve
50 handle body
51 circumferential groove
52 circumferential groove
53 arms
55 tool head portion
56 passage
58 port
59 port
60 crimper and decapper tool
C cap
S seal
V vial

I claim:

1. A hand held, power-operated, or power-assisted, crimper decapper tool (60), comprising a hollow handle body (50), housing a fluid powered actuator (12,13);

a fluid control valve (16), for controlling fluid pressure supply to the actuator;

and an operating trigger (18) for the control valve;

a transverse head portion (55), with a demountable connection (28), for an output unit (27), and housing a drive transfer coupling (10), for operative driving connection between the actuator and a mounted output unit, characterised by a pivoted bell crank, with angularly offset, differential length, lever arms (10A, 10B), configured to impart angular displacement, and mechanical advantage, through one crank arm engaging an actuator output rod (15) and the other engaging a drive plunger (35), of a crimping and decapping/er unit.

2. A tool as claimed in claim 1, wherein the transition housing accommodates a relatively long crank arm, with an offset nose stub disposed within the fluid actuator, to sit in the path of an actuator drive transfer rod, and a relatively shorter crank stub arm, disposed alongside a crank pivot, with a stub nose juxtaposed with a drive plunger, of a crimper or decapper unit.

3. A tool as claimed in claim 1, wherein arcuate drive transfer movement of the longer arm, attendant the relative angular (offset) disposition of differential length and profile lever arms, is accommodated by a local (flared) enlargement of the transition housing, to preserve a compact overall tool form.

4. A tool as claimed in claim 1, wherein the handle body is angularly offset from a tool head, configured for a crimping and decapping unit.

5. A tool as claimed in claim 1, wherein pneumatic or hydraulic fluid drive pressure is derived from a remote source, reservoir or supply, through a detachable connection, to an internal fluid distribution block.

6. A tool as claimed in claim 1, wherein fluid drive pressure connection is controlled by a remotely operated valve, coupled through an internal distribution block, and bypassing an on-board trigger.

7. A tool as claimed in claim 1, wherein said crimping and decapping unit has a collet-chuck, with a plurality of radially-displaceable jaws, and an axially-movable punch for jaw displacement.

* * * * *